US008464393B2

(12) United States Patent
Kao

(10) Patent No.: US 8,464,393 B2
(45) Date of Patent: Jun. 18, 2013

(54) HINGE DEVICE FOR USE IN OFFICE MACHINE

(75) Inventor: Chia-Hung Kao, Taoyuan Hsien (TW)

(73) Assignee: Teco Image System Co., Ltd., Taoyuan Hsien (TW)

( * ) Notice: Subject to any disclaimer, the term of this patent is extended or adjusted under 35 U.S.C. 154(b) by 399 days.

(21) Appl. No.: 12/503,258

(22) Filed: Jul. 15, 2009

(65) Prior Publication Data

US 2010/0125971 A1 May 27, 2010

(30) Foreign Application Priority Data

Nov. 21, 2008 (TW) ..... 97145236 A

(51) Int. Cl.
*E05D 11/10* (2006.01)

(52) U.S. Cl.
USPC ..... 16/335; 16/277; 16/286; 16/292

(58) Field of Classification Search
USPC ..... 16/274, 277, 226, 231, 232, 286, 16/289, 292, 297, 319, 321, 334, 335, 336, 16/344, 347, 374, 375; 399/380; 296/97.12, 296/97.13
See application file for complete search history.

(56) References Cited

U.S. PATENT DOCUMENTS

| | | | | |
|---|---|---|---|---|
| 600,540 | A * | 3/1898 | Langley | 16/334 |
| 3,237,239 | A * | 3/1966 | Rudnick | 16/335 |
| 4,114,236 | A * | 9/1978 | Vandervort | 16/335 |
| 5,632,066 | A * | 5/1997 | Huong | 16/338 |
| 6,470,532 | B2 * | 10/2002 | Rude | 16/335 |
| 7,076,836 | B1 * | 7/2006 | Butka | 16/342 |
| 7,406,747 | B2 * | 8/2008 | Chol | 16/239 |
| 7,469,446 | B1 * | 12/2008 | Brown et al. | 16/334 |
| 7,636,984 | B2 * | 12/2009 | Oh | 16/374 |
| 7,721,388 | B2 * | 5/2010 | Lee | 16/286 |

FOREIGN PATENT DOCUMENTS

GB 2220030 A * 12/1989

* cited by examiner

*Primary Examiner* — Jeffrey O Brien

(57) ABSTRACT

A hinge device is used in an office machine including a main body and an upper cover. The hinge device includes a base, a rotating shaft and an elastic structure. The base includes a connecting part and a shaft sleeve part. The connecting part is fixed on the main body. The shaft sleeve part has a channel and a baffle. The baffle is arranged at an external surface of the shaft sleeve part. The rotating shaft is penetrated through the channel. The elastic structure includes a fixing part and a bending part. The bending part is correspondingly moved on the external surface of the shaft sleeve part during a process of opening or closing the upper cover. When the bending part is sustained against the baffle, the upper cover is positioned in an open status to define an included angle between the upper cover and the main body.

23 Claims, 8 Drawing Sheets

HINGE DEVICE FOR USE IN OFFICE MACHINE

CLAIM OF PRIORITY

This application claims priority to Taiwanese Patent Application No. 097145236 filed on Nov. 21, 2008.

FIELD OF THE INVENTION

The present invention relates to a hinge device, and more particularly to a hinge device for use in an office machine.

BACKGROUND OF THE INVENTION

With increasing industrial development, digitalized office technologies have experienced great growth and are now rapidly gaining in popularity. For example, a diversity of office machines such as copy machines, printers, fax machines and scanners (also referred as single-function peripherals) are utilized to achieve various purposes. The diverse office machines, however, occupy lots of space. Nowadays, a multifunction peripheral having multiple functions in one structural unit, for example the functions of a printer, a scanner, a fax machine and/or a copy machine, is thus developed. As a consequence, the processing capability of the multifunction peripheral is increased and the operative space thereof is reduced. Moreover, the process of assembling the multifunction peripheral is simplified. Generally, a single network line, a single telephone line and a single power line are sufficient to communicate the multifunction peripheral with the computer system. As a consequence, the multifunction peripheral is rapidly gaining in popularity.

For performing the printing operation or the scanning operation, the upper cover of the multifunction peripheral needs to be uplifted and then the document to be printed or scanned is placed on the sensitive platform. Typically, the multifunction peripheral comprises a hinge device or a linkage mechanism between the upper cover and a main body thereof in order for pulling open the upper cover. Since the automatic document feeder and the infrared ray image input device of the multifunction peripheral are usually mounted on the upper cover, the upper cover is very weighty. If the hinge device or the linkage mechanism fails to securely withstand the weight of the upper cover, the upper cover will be undesirably pressed on the main body. The strong impact resulted from the upper cover is detrimental to the electronic components of the multifunction peripheral and the safety of the user or maintenance worker.

Recently, the hinge device is continuously improved in order to increase the supporting force to be exerted on the upper cover. In addition, the hinge device also has the functions of positioning and slowly closing the upper cover.

As known, the conventional hinge device has many components, including for example a cam, an upper body, a lower body, a compressing spring, a spring gliding seat, a fixing pin and the like. For assembling these components, a jig tool is required, and thus the assembling process is complicated and labor-intensive. As a result, the fabricating cost is increased and the hinge device is less competitive.

For assuring the smoothness of opening and closing the upper cover of the office machine and reducing the fabricating cost, there is a need of providing an improved hinge device so as to obviate the drawbacks encountered from the prior art.

SUMMARY OF THE INVENTION

It is an object of the present invention to provide a hinge device of an office machine for supporting the upper cover of the office machine during the process of opening or closing the upper cover, thereby increasing the stability and safety.

Another object of the present invention provides a hinge device of an office machine for positioning the upper cover in an open status, thereby providing an operating space to place the document to be printed or scanned.

A further object of the present invention provides a hinge device of an office machine, in which fewer components are used and no jig tool is required to assemble the hinge device, thereby simplifying the assembling process.

In accordance with an aspect of the present invention, there is provided a hinge device for use in an office machine. The office machine includes a main body and an upper cover. The hinge device includes a base, a rotating shaft and an elastic structure. The base includes a connecting part and a shaft sleeve part. The connecting part is connected with and fixed on the main body. The shaft sleeve part has a channel and a baffle. The baffle is arranged at an external surface of the shaft sleeve part. The rotating shaft is penetrated through the channel of the shaft sleeve part and fixed on the upper cover. The elastic structure includes a fixing part fixed on the upper cover and a bending part contacted with the shaft sleeve part. The bending part is correspondingly moved on the external surface of the shaft sleeve part during a process of opening or closing the upper cover. When the bending part is sustained against the baffle, the upper cover is positioned in an open status to define an included angle between the upper cover and the main body.

In accordance with another aspect of the present invention, there is provided an office machine. The office machine includes a main body, an upper cover and a hinge device. The upper cover is placed on the main body. The hinge device is arranged between the main body and the upper cover. The hinge device includes a base, a rotating shaft and an elastic structure. The base includes a connecting part and a shaft sleeve part. The connecting part is connected with and fixed on the main body. The shaft sleeve part has a channel and a baffle. The baffle is arranged at an external surface of the shaft sleeve part. The rotating shaft is penetrated through the channel of the shaft sleeve part and fixed on the upper cover. The elastic structure includes a fixing part fixed on the upper cover and a bending part contacted with the shaft sleeve part. The bending part is correspondingly moved on the external surface of the shaft sleeve part during a process of opening or closing the upper cover. When the bending part is sustained against the baffle, the upper cover is positioned in an open status to define an included angle between the upper cover and the main body.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
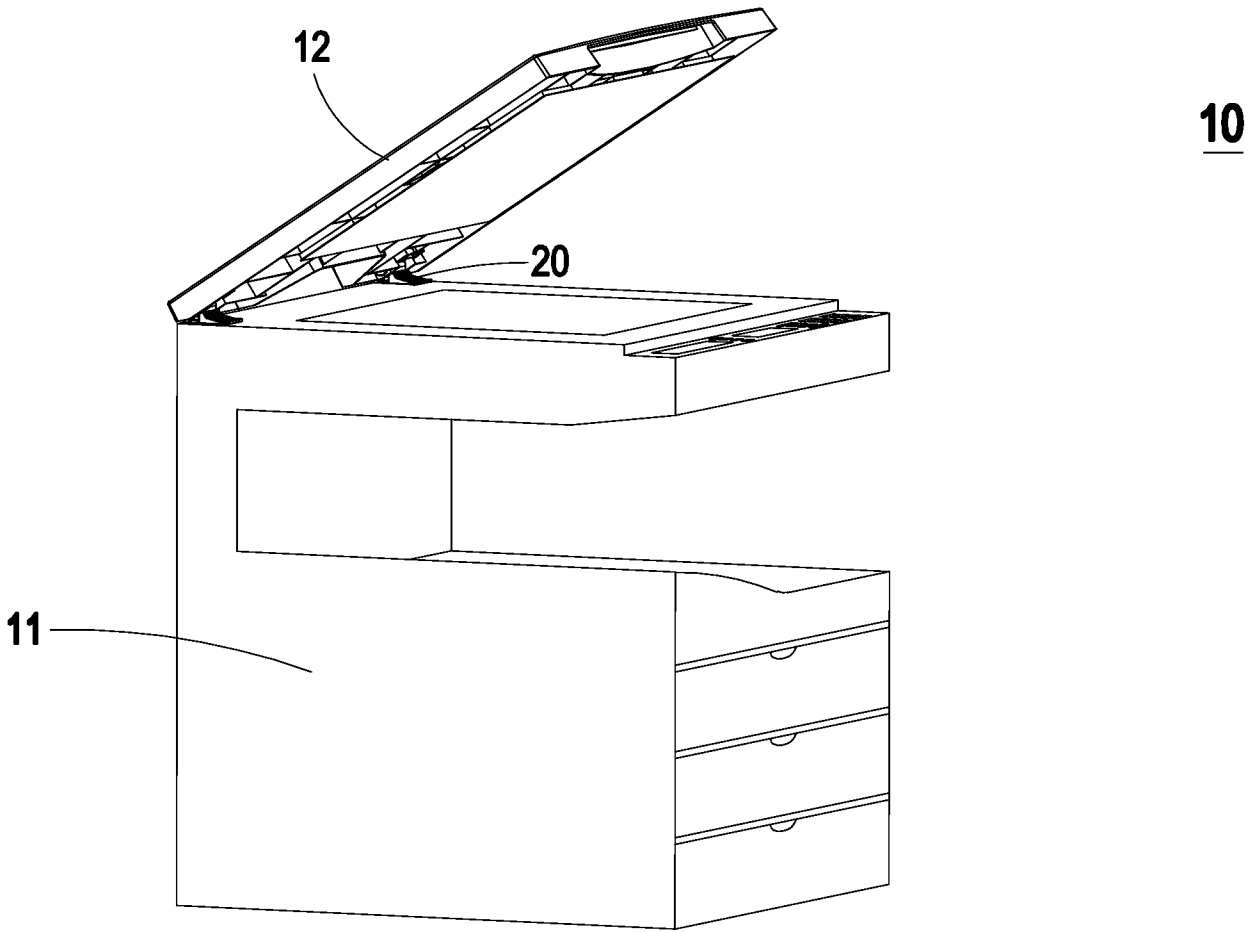
FIG. 1 is a schematic perspective view illustrating an office machine according to an embodiment of the present invention.

The present invention provides a hinge device for use in an office machine. FIG. 1 is a schematic perspective view illustrating an office machine according to an embodiment of the present invention. As shown in FIG. 1, the office machine 10 comprises a main body 11 and an upper cover 12. In addition, a hinge device 20 is arranged between the main body 11 and the upper cover 12. During the process of opening or closing the upper cover 12, the upper cover 12 is supported by the hinge device 20 in order to increase the stability and safety of operating the office machine 10. An example of the office machine 10 includes but is not limited to a copy machine, a printer, a fax machine and a scanner. Alternatively, the office machine 10 is a multifunction peripheral having two or more functions in one structural unit, for example the functions of a printer, a scanner, a fax machine and/or a copy machine. Alternatively, the office machine 10 is any other electronic device having a foldable upper cover. In some embodiments, the upper cover 12 could contain other important components such as an automatic document feeder, the infrared ray image input device, and the like.

Figure 2:
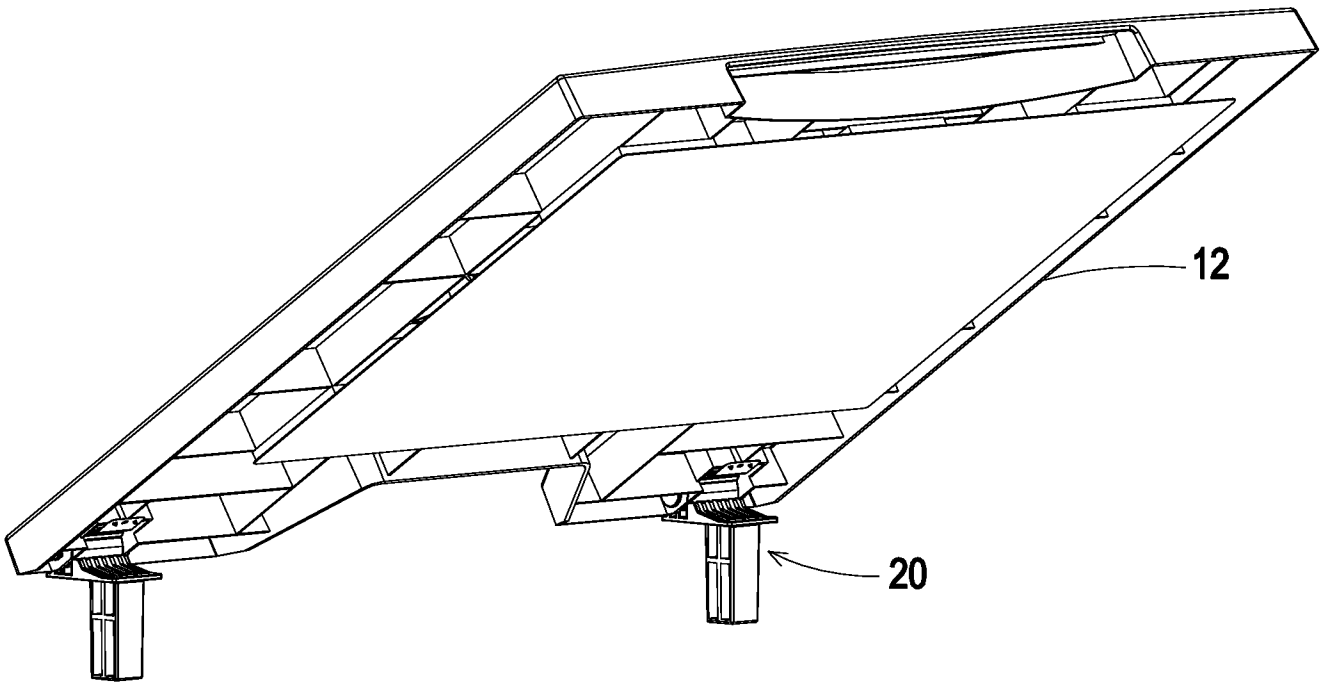
FIGS. 2 and 3 are schematic assembled views illustrating the hinge device and the upper cover according to an embodiment of the present invention.
Figure 3:
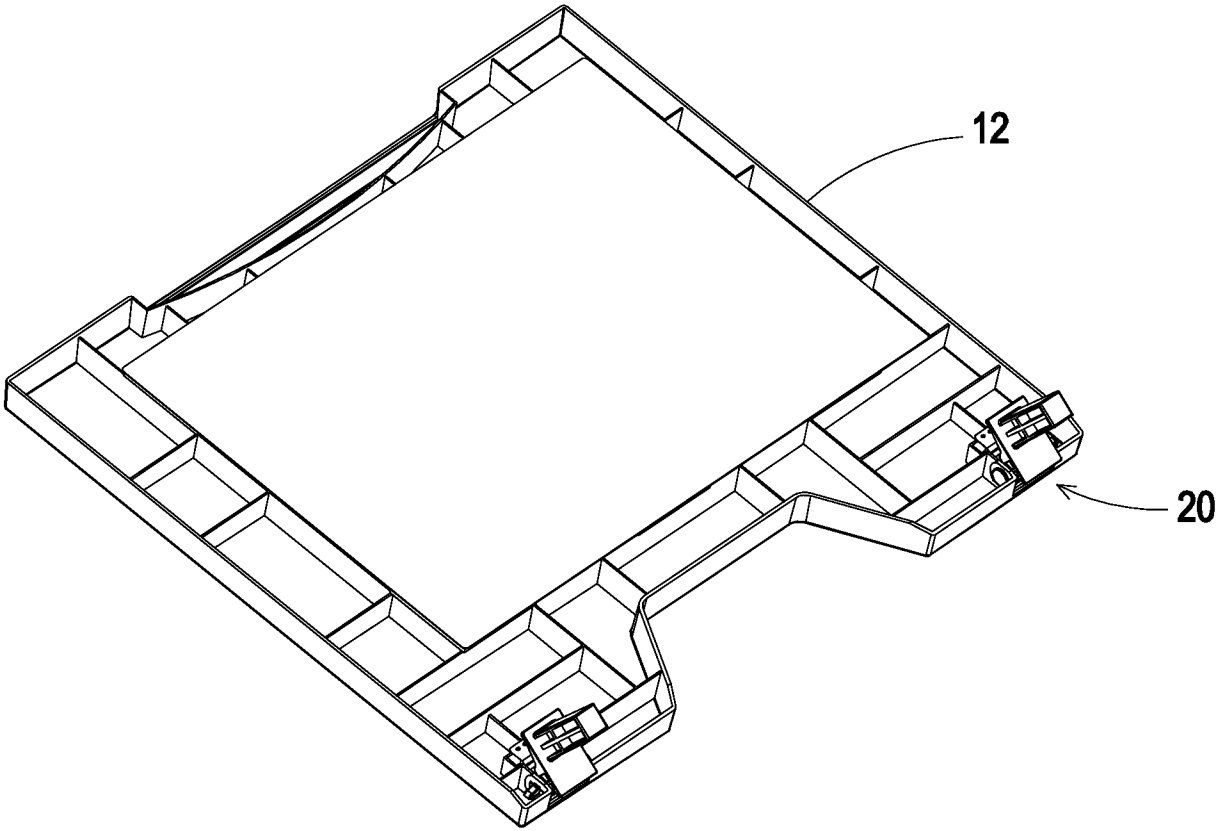
Figure 4:
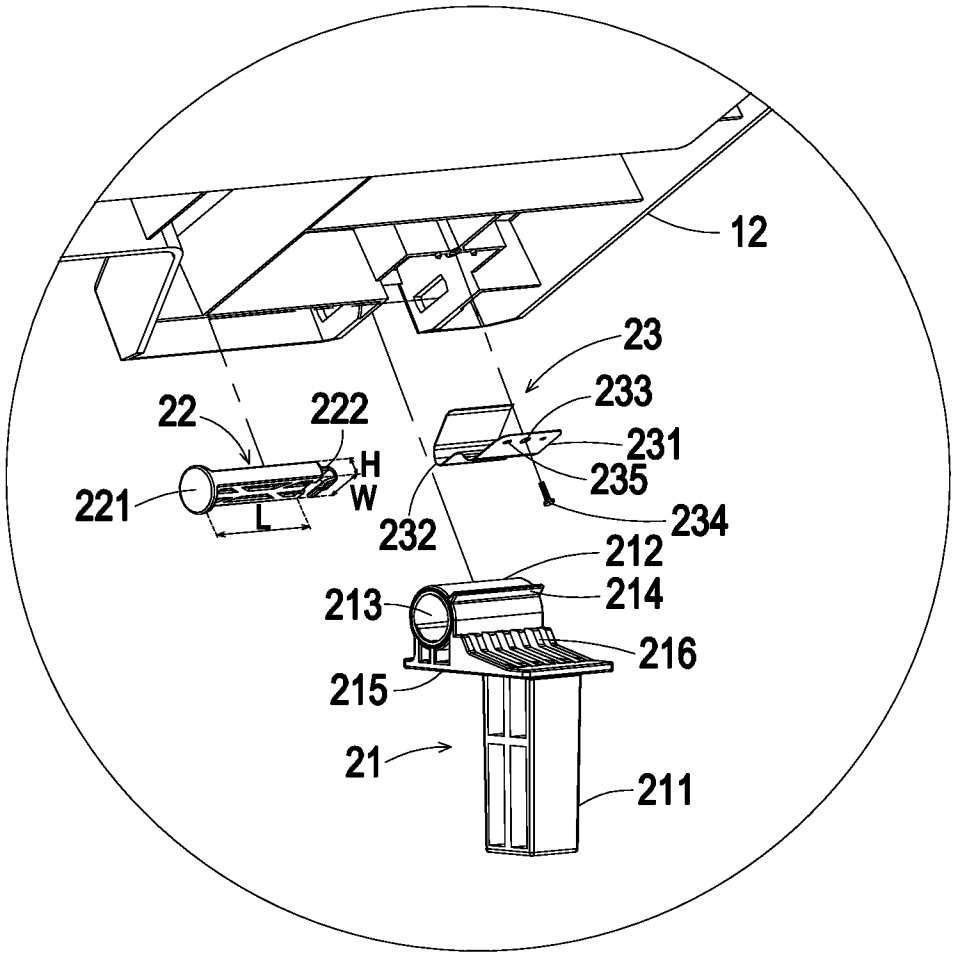
FIGS. 4 and 5 are schematic exploded views illustrating the hinge device and the upper cover according to the embodiment of the present invention.
Figure 5:
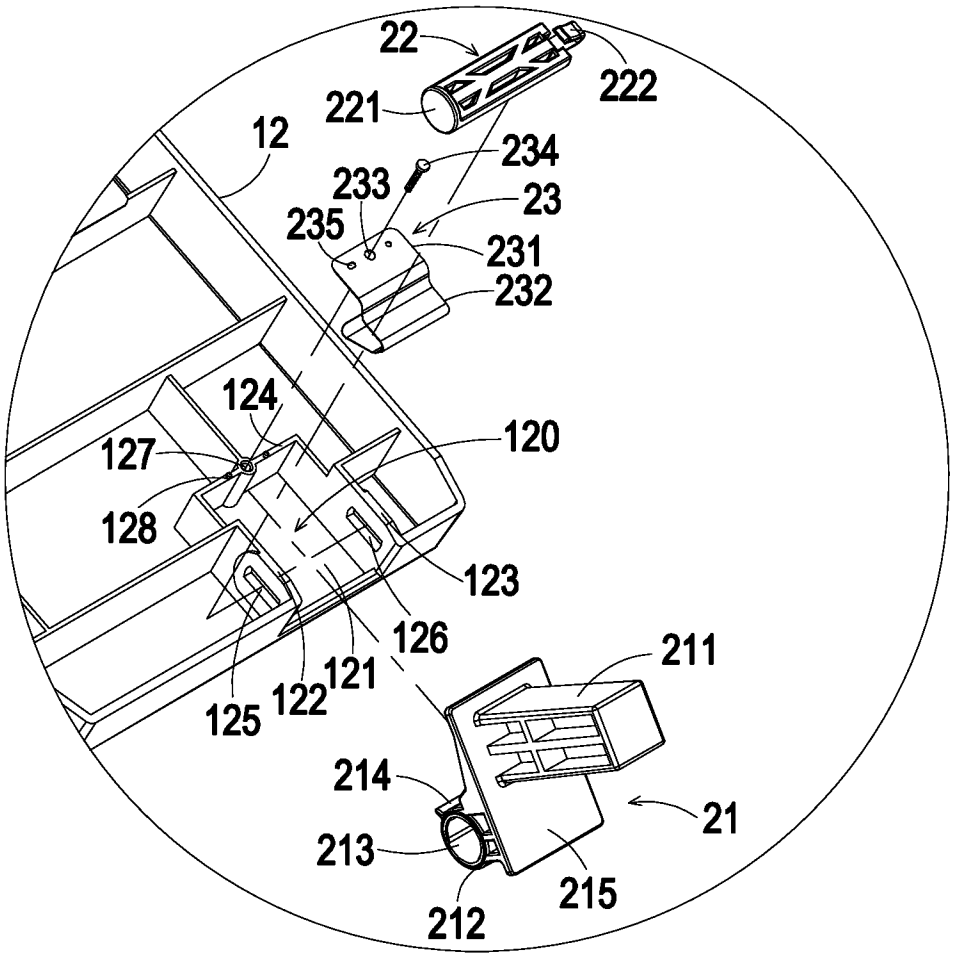

FIGS. 2 and 3 are schematic assembled views of the hinge device and the upper cover according to an embodiment of the present invention. FIGS. 4 and 5 are schematic exploded views illustrating the hinge device and the upper cover according to the embodiment of the present invention. Please refer to FIGS. 2, 3, 4 and 5. The hinge device 20 comprises a base 21, a rotating shaft 22 and an elastic structure 23. The base 21 has a connecting part 211 and a shaft sleeve part 212. The connecting part 211 is connected with and fixed on the main body 11 of the office machine 10. The shaft sleeve part 212 is accommodated within a receptacle 120 of the upper cover 12. The shaft sleeve part 212 is substantially a hollow cylindrical element with a channel 213 and a baffle 214. The baffle 214 is arranged at the external surface of the shaft sleeve part 212. In addition, the base 21 further comprises a support part 215. The support part 215 is arranged between the connecting part 211 and the shaft sleeve part 212. A plurality of ribs 216 are formed on a surface of the support part 215 for facilitating supporting the shaft sleeve part 212 and structurally strengthening the base 21. It is preferred that the connecting part 211, the shaft sleeve part 212 and the support part 215 are integrally formed with the base 21.

The rotating shaft 22 is penetrated through the channel 213 of the shaft sleeve part 212. In this embodiment, the rotating shaft 22 is substantially a rectangular solid with a length L, a width W and a height H. The length L of the rotating shaft 22 is slightly greater than the length of the shaft sleeve part 212. The width W of the rotating shaft 22 is equal to or slightly smaller than the diameter of the channel 213 of the shaft sleeve part 212. When the rotating shaft 22 is penetrated through the channel 213 of the shaft sleeve part 212, the rotating shaft 22 is in contact with the inner wall of the channel 213 and interference-fitted into the channel 213. As such, the rotating shaft 22 is permitted to be rotated within the channel 213.

Please refer to FIGS. 4 and 5. The receptacle 120 of the upper cover 21 for accommodating the shaft sleeve part 212 is defined by a upper cover bottom surface 121, a first sidewall 122, a second sidewall 123 and a third sidewall 124. The first sidewall 122 and the second sidewall 123 are opposed to each other. A first perforation 125 and a second perforation 126 are formed in the first sidewall 122 and the second sidewall 123, respectively. The first perforation 125 and the second perforation 126 have shapes (e.g. rectangular shapes) mating with the rotating shaft 22. Moreover, the spacing interval between the first sidewall 122 and the second sidewall 123 is substantially equal to the length of the shaft sleeve part 212. For assembling the hinge device 20 on the upper cover 12, the rotating shaft 22 is successively penetrated through the first perforation 125, the channel 213 of the shaft sleeve part 212 and the second perforation 126. As such, the rotating shaft 22 is tightly fitted into the first perforation 125 and the second perforation 126.

As previously described, the rotating shaft 22 is tightly fitted into the first perforation 125 and the second perforation 126. In addition, a first engaging element (e.g. a lateral plate 221) and a second engaging element (e.g. a hook 222) are respectively formed on both terminals of the rotating shaft 22. The area of the lateral plate 221 is greater than the cross-section area of the rotating shaft 22. The hook 222 is made of elastic material (e.g. plastic material). Since the hook 222 is made of elastic material, the hook 222 is deformed when hook 222 of the rotating shaft 22 is successively penetrated through the first perforation 125, the channel 213 of the shaft sleeve part 212 and the second perforation 126. Afterwards, the lateral plate 221 and the hook 222 are respectively attached onto the first sidewall 122 and the second sidewall 123, so that the rotating shaft 22 is fixed on the upper cover 12 and the upper cover 12 could be pivotal about the rotating shaft 22.

The shapes of the rotating shaft 22, the first perforation 125 and the second perforation 126 are not restricted to the rectangular shapes. In addition, the mechanism for coupling the rotating shaft 22 with the upper cover 12 may be modified as required.

Please refer to FIGS. 4 and 5 again. The elastic structure 23 is an elastic sheet, which is produced by bending a metallic sheet. The elastic structure 23 includes a fixing part 231 and a bending part 232. The fixing part 231 is fixed on the upper cover 21 by screwing, adhering or other fastening means. In this embodiment, a first opening 233 is formed in the fixing part 231, and an insertion hole 127 is formed in the third sidewall 124 of the upper cover 21. By penetrating a screw 234 through the first opening 233 and tightening the screw 234 into the insertion hole 127, the fixing part 231 is fixed on the upper cover 21. Alternatively, a second opening 235 is formed in the fixing part 231, and a salient 128 is formed on the third sidewall 124 of the upper cover 21. The salient 128 is inserted into the second opening 235 in order to facilitate fixing the fixing part 231 on the upper cover 21. In this embodiment, the bending part 232 is substantially U-shaped. An end of the U-shaped bending part 232 is connected with the fixing part 231. The other end of the U-shaped bending part 232 is sustained against the upper cover bottom surface 121 within the receptacle 120. The bottom periphery of the U-shaped bending part 232 is contacted with the external surface of the shaft sleeve part 212. During the process of opening or closing the upper cover 12, the U-shaped bending part 232 is movable on the external surface of the shaft sleeve part 212. The baffle 214 of the shaft sleeve part 212 is served as a positioning point during the process of opening or closing the upper cover 12, which will be illustrated later.

Figure 6:
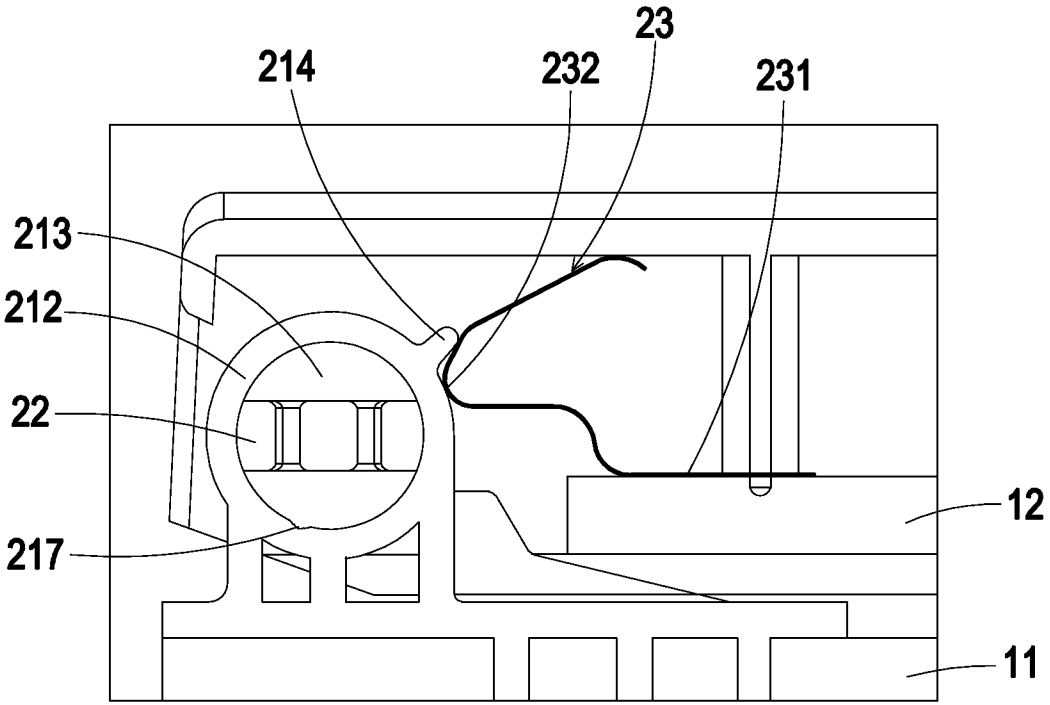
FIGS. 6, 7 and 8 schematically illustrate the operations of the hinge device during the process of opening or closing the upper cover.
Figure 7:
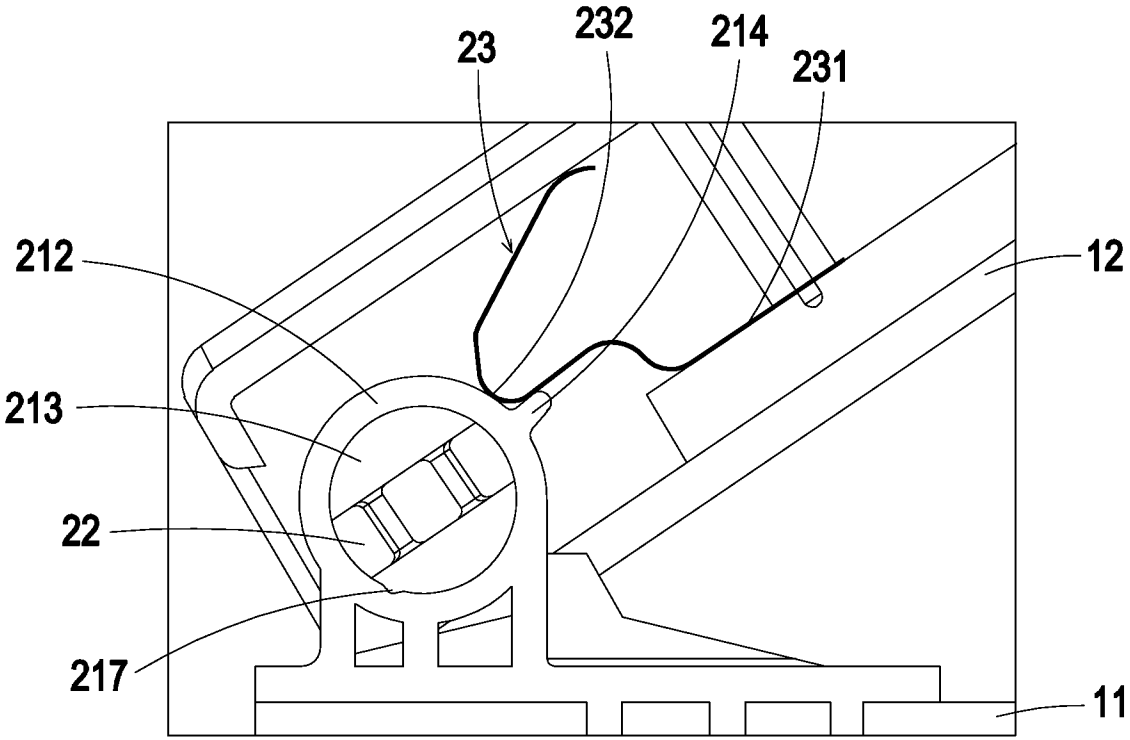
Figure 8:
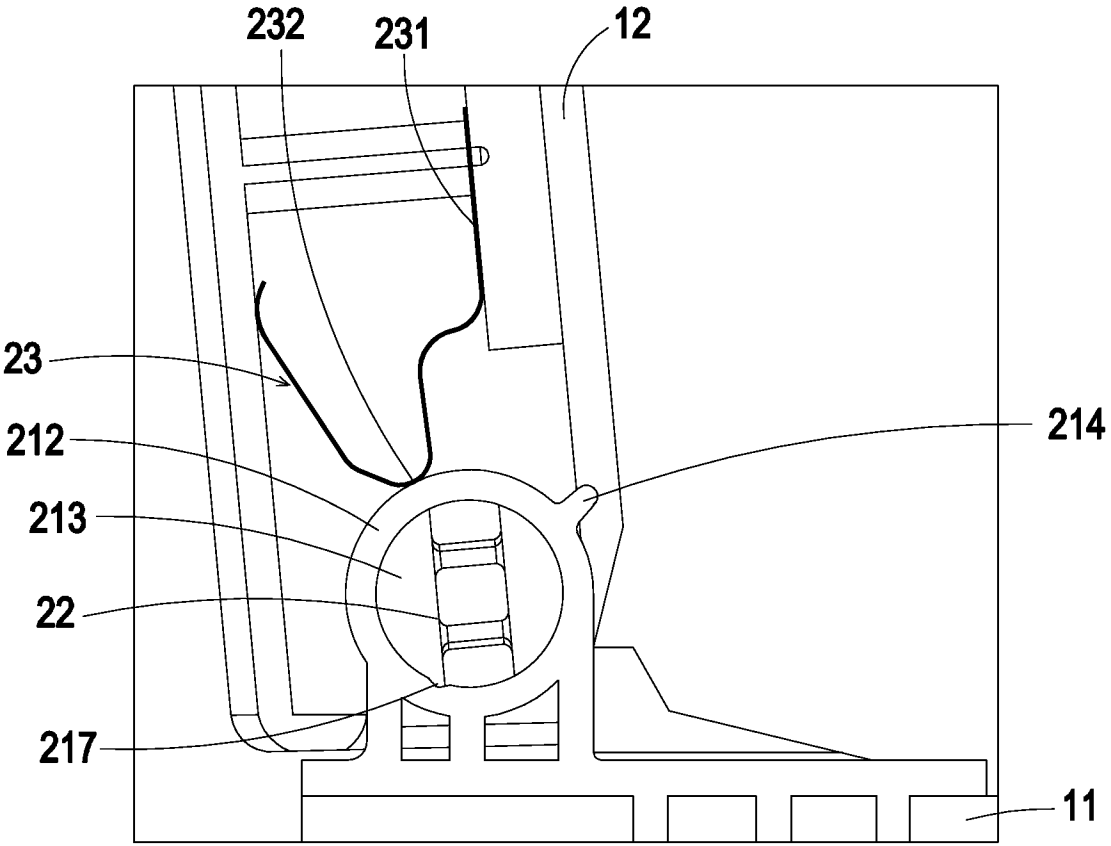

FIGS. 6, 7 and 8 schematically illustrate the operations of the hinge device during the process of opening or closing the upper cover. As shown in FIG. 6, when the upper cover 12 is in a close status and placed on the main body 11, the bending part 232 of the elastic structure 23 is sustained against the external surface of the shaft sleeve part 212 and under the baffle 214. Due to the internally-concave interference amount, the rotating shaft 22 is clearance-fitted into the shaft sleeve part 212. For opening the upper cover 12 to operate the office machine 10, an uplifting force is exerted on the upper cover 12 to deform the elastic structure 23. Due to deformation of the elastic structure 23, the bending part 232 of the elastic structure 23 is moved to be across the baffle 214 and then sustained against the upper portion of the baffle 214 (see FIG. 7). Since there is sufficient interference amount between the shaft sleeve part 212 and the rotating shaft 22, the rotating shaft 22 is interference-fitted into the shaft sleeve part 212. Since the bending part 232 of the elastic structure 23 is sustained against the upper portion of the baffle 214, the upper cover 12 is supported by the elastic force of the bending part 232 and fixed in an open position. Under this circumstance, an included angle is defined between the upper cover 12 and the main body 10 to provide an operating space in order to place the document to be printed or scanned on the sensitive platform. For expanding the operating space, the upper cover 12 could be further uplifted (see FIG. 8).

In the above embodiments, the included angle between the upper cover 12 and the main body 10 when the upper cover 12 is fixed in the open position is determined according to the location of the baffle 214 with respect to the shaft sleeve part 212 (see FIG. 7). By adjusting the location of the baffle 214 with respect to the shaft sleeve part 212, the included angle between the upper cover 12 and the main body 10 when the upper cover 12 is fixed in the open position is variable. For example, the included angle could be ranged from 30 to 60 degrees or any other desired angle. Moreover, more than two baffles 214 could be arranged on the external surface of the shaft sleeve part 212 in order to impart multi-stage included angles when the upper cover 12 is fixed in the open position.

In some embodiments, the base 21 and the rotating shaft 22 are made of plastic material. Due to the abrasion resistance and the strong elasticity of the plastic material, the interference positioning effect between the shaft sleeve part 212 and the rotating shaft 22 is rendered. For increasing the use life and enhancing the smoothness of operating the upper cover 22, the inner wall of the channel 213 of the shaft sleeve part 212 could be coated with lubricating oil. In addition, an oil reservoir recess 217 (see FIG. 6) is formed in the inner wall of the channel 213 for collecting the lubricating oil.

On the other hand, during the upper cover 12 is closed from the location of FIG. 8 to the location of FIG. 7, the bending part 232 of the elastic structure 23 is also sustained against the upper portion of the baffle 214 and thus upper cover 12 is supported by the elastic force of the bending part 232 and fixed in an open position. Under this circumstance, the components within the upper cover 12 are protected from being damaged because the upper cover 12 is not suddenly closed. For placing the upper cover 12 on the main body 11, a pressing force is exerted on the upper cover 12 to deform the elastic structure 23. Due to deformation of the elastic structure 23, the bending part 232 of the elastic structure 23 is moved to be across the baffle 214 and then sustained against the lower portion of the baffle 214 (see FIG. 6).

As shown in FIG. 1, the office machine 10 of the present invention includes two hinge devices 20, which are symmetrically arranged between the main body 11 and the upper cover 12. It is noted that the office machine 10 may have more or less than two hinge devices. For example, in a case that the office machine 10 has only one hinge device 20, the hinge device 20 is preferred arranged at the middle portion and an edge of the upper cover 12. Moreover, if the upper cover 12 is very weighty, the office machine 10 could have three or more hinge devices 20 in order to enhance the force for supporting the upper cover 12.

From the above description, the hinge device of the office machine according to the present invention is capable of positioning the upper cover in an open status, thereby providing an operating space to placing the document to be printed or scanned. Due to deformation of the elastic structure, the bending part of the elastic structure is moved to be sustained against the baffle in order to define an included angle between the upper cover and the main body. Since the use of the hinge device could prevent the upper cover from being suddenly closed, the possibility of damaging the components within the upper cover will be minimized. Moreover, since fewer components are used in the hinge device and no jig tool is required to assemble the hinge device, the assembling process of the hinge device according to the present invention is simplified and cost-effective.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A hinge device of an office machine, said office machine comprising a main body and a rotatable upper cover, said hinge device comprising:

a base including a connecting part and a shaft sleeve part, wherein said connecting part is connected with and fixed on said main body, said shaft sleeve part has a channel and a baffle, and said baffle is a protruding plate extended from an external surface of said shaft sleeve part;

a rotating shaft penetrated through said channel of said shaft sleeve part and fixed on said upper cover; and an elastic structure including a fixing part fixed on said upper cover and a bending part contacted with said shaft sleeve part, wherein said bending part is correspondingly moved on said external surface of the shaft sleeve part during a process of opening or closing said upper cover, said baffle is served as a positioning point, when said upper cover is changed from a close status to an open status, said bending part is moved from a lower portion of said baffle to be across said baffle and sustained against an upper portion of said baffle, so that said bending part is supported by said baffle and said upper cover is supported by said elastic structure to position said upper cover in said open status and define an included angle between said upper cover and said main body, and said rotating shaft is in contact with an inner wall of said channel and interference-fitted into said channel in said open status.

2. The hinge device according to claim 1 wherein said shaft sleeve part is substantially a hollow cylindrical element with said channel.

3. The hinge device according to claim 2 wherein an inner wall of said channel of said shaft sleeve part is coated with lubricating oil, and an oil reservoir recess is formed in said inner wall of the channel for collecting said lubricating oil.

4. The hinge device according to claim 1 wherein said upper cover has at least one perforation corresponding to said rotating shaft, and said rotating shaft is penetrated through and fixed in said perforation.

5. The hinge device according to claim 1 wherein a first engaging element and a second engaging element are respectively formed on both terminals of said rotating shaft for facilitating fixing said rotating shaft on said upper cover.

6. The hinge device according to claim 1 wherein said elastic structure includes an elastic sheet, which is produced by bending a metallic sheet.

7. The hinge device according to claim 1 wherein said bending part of said elastic structure is substantially U-shaped, a first end of said U-shaped bending part is connected with said fixing part, a second end of said U-shaped bending part is sustained against said upper cover, and a bottom periphery of said U-shaped bending part is contacted with said external surface of said shaft sleeve part.

8. The hinge device according to claim 1 wherein said base further comprises a support part between said connecting part and said shaft sleeve part, and said support part has a plurality of ribs for facilitating supporting said shaft sleeve part and structurally strengthening said base.

9. The hinge device according to claim 1 wherein said shaft sleeve part and said rotating shaft are made of plastic material.

10. The hinge device according to claim 5 wherein said first engaging element is a lateral plate and said second engaging element is a hook.

11. The hinge device according to claim 1 wherein said rotating shaft is substantially a rectangular solid.

12. The hinge device according to claim 1 wherein said rotating shaft is rotatable within said channel.

13. The hinge device according to claim 1 wherein said elastic structure is fixed on said upper cover by a screw.

14. The hinge device according to claim 1 wherein an end of said bending part is connected with said fixing part and the other end of said bending part is sustained against a bottom surface of said upper cover.

15. An office machine comprising:

a main body;

a rotatable upper cover placed on said main body; and a hinge device arranged between said main body and said upper cover, and comprising:

a base including a connecting part and a shaft sleeve part, wherein said connecting part is connected with and fixed on said main body, said shaft sleeve part has a channel and a baffle, and said baffle is a protruding plate extended from an external surface of said shaft sleeve part;

a rotating shaft penetrated through said channel of said shaft sleeve part and fixed on said upper cover; and an elastic structure including a fixing part fixed on said upper cover and a bending part contacted with said shaft sleeve part, wherein said bending part is correspondingly moved on said external surface of the shaft sleeve part during a process of opening or closing said upper cover, said baffle is served as a positioning point, and when said upper cover is changed from a close status to an open status, said bending part is moved from a lower portion of said baffle to be across said baffle and sustained against an upper portion of said baffle, so that said bending part is supported by said baffle and said upper cover is supported by said elastic structure to position said upper cover in said open status and define an included angle between said upper cover and said main body, and said rotating shaft is in contact with an inner wall of said channel and interference-fitted into said channel in said open status.

16. The office machine according to claim 15 wherein said shaft sleeve part is substantially a hollow cylindrical element with said channel.

17. The office machine according to claim 16 wherein an inner wall of said channel of said shaft sleeve part is coated with lubricating oil, and an oil reservoir recess is formed in said inner wall of the channel for collecting said lubricating oil.

18. The office machine according to claim 15 wherein said upper cover has at least one perforation corresponding to said rotating shaft, and said rotating shaft is penetrated through and fixed in said perforation.

19. The office machine according to claim 15 wherein a first engaging element and a second engaging element are respectively formed on both terminals of said rotating shaft for facilitating fixing said rotating shaft on said upper cover.

20. The office machine according to claim 15 wherein said elastic structure includes an elastic sheet, which is produced by bending a metallic sheet.

21. The office machine according to claim 15 wherein said bending part of said elastic structure is substantially U-shaped, a first end of said U-shaped bending part is connected with said fixing part, a second end of said U-shaped bending part is sustained against said upper cover, and a bottom periphery of said U-shaped bending part is contacted with said external surface of said shaft sleeve part.

22. The office machine according to claim 15 wherein said base further comprises a support part between said connecting part and said shaft sleeve part, and said support part has a plurality of ribs for facilitating supporting said shaft sleeve part and structurally strengthening said base.

23. The office machine according to claim 15 wherein said shaft sleeve part and said rotating shaft are made of plastic material.

* * * * *